US007438633B2

(12) United States Patent
Jespersen

(10) Patent No.: US 7,438,633 B2
(45) Date of Patent: Oct. 21, 2008

(54) APPARATUS FOR GRINDING A SURFACE COMPRISING TWO MOVABLY ARRANGED HOODS

(75) Inventor: Poul Erik Jespersen, Roslev (DK)

(73) Assignee: Flex Trim A/S, Roslev (DK)

( * ) Notice: Subject to any disclaimer, the term of this patent is extended or adjusted under 35 U.S.C. 154(b) by 0 days.

(21) Appl. No.: 11/795,669

(22) PCT Filed: Jan. 20, 2006

(86) PCT No.: PCT/DK2006/000035

§ 371 (c)(1),
(2), (4) Date: Oct. 15, 2007

(87) PCT Pub. No.: WO2006/092138

PCT Pub. Date: Sep. 8, 2006

(65) Prior Publication Data

US 2008/0032612 A1 Feb. 7, 2008

(30) Foreign Application Priority Data

Jan. 21, 2005 (DK) ..... 2005 00028
Jun. 16, 2005 (DK) ..... 2005 00889 U

(51) Int. Cl.
*B24B 23/00* (2006.01)

(52) U.S. Cl. ..... 451/350; 451/451; 451/456; 451/496; 451/466; 125/13.01

(58) Field of Classification Search ..... 451/350, 451/451, 453, 456, 496, 497, 498, 466, 502, 451/503; 125/13.01
See application file for complete search history.

(56) References Cited

U.S. PATENT DOCUMENTS

| | | | | |
|---|---|---|---|---|
| 1,271,639 | A | 7/1918 | Watters | |
| 1,904,893 | A | 4/1933 | Weidrich | |
| 3,139,641 | A | 7/1964 | Grogan et al. | |
| 5,167,215 | A * | 12/1992 | Harding, Jr. | 125/13.01 |
| 5,341,605 | A * | 8/1994 | Tasikas | 451/350 |
| 5,575,710 | A | 11/1996 | Kramer | |
| 5,788,561 | A * | 8/1998 | Pearlman et al. | 451/353 |
| 6,827,640 | B2 * | 12/2004 | Bures et al. | 451/456 |
| 6,916,236 | B2 * | 7/2005 | Terpstra | 451/358 |
| 7,247,085 | B1 * | 7/2007 | Anderson | 451/350 |

(Continued)

FOREIGN PATENT DOCUMENTS

DE 3316847 11/1984

(Continued)

*Primary Examiner*—Eileen P. Morgan
(74) *Attorney, Agent, or Firm*—James Creighton Wray; Clifford D. Hyra

(57) ABSTRACT

The present invention concerns an apparatus (1), preferably for grinding a surface, including at least one grinding unit, a screen (2, 3) and a guide member (5), where the grinding unit is a rotatable and preferably horizontally arranged grinding cylinder, which at a cylinder surface is provided with a number of preferably exchangeable grinding elements, where the screen (2, 3) entirely or partly encloses the grinding unit, and where the guide member (5) is connected with the screen (2), and where the screen includes an outer screen (2) and an inner screen (3) which are mutually movably connected, and where the inner screen (3) includes a first suction screen (11) and a second screen (12) which are mutually movably connected.

10 Claims, 5 Drawing Sheets

U.S. PATENT DOCUMENTS

2005/0034715 A1* 2/2005 Terpstra ..... 125/13.01

FOREIGN PATENT DOCUMENTS

| | | |
|---|---|---|
| DE | 3919701 | 12/1990 |
| DE | 4226681 | 2/1994 |
| EP | 0261658 | 3/1988 |
| GB | 1038395 | 8/1966 |
| WO | WO 96/29178 | 9/1996 |

* cited by examiner

APPARATUS FOR GRINDING A SURFACE COMPRISING TWO MOVABLY ARRANGED HOODS

This application claims the benefit of Danish Application No. BA 2005 00028 filed Jan. 21, 2005, Danish Application No. PA 2005 00889 filed Jun. 16, 2005, and PCT/DK2006/000035 filed Jan. 20, 2006, which are hereby incorporated by reference in their entirety.

FIELD OF THE INVENTION

The present invention concerns an apparatus, preferably for grinding a surface, including at least one grinding unit, a screen and a guide member, where the grinding unit is a rotatable and preferably horizontally arranged grinding cylinder, which at a cylinder surface is provided with a number of preferably exchangeable grinding elements, where the screen entirely or partly encloses the grinding unit, and where the guide member is connected with the screen.

BACKGROUND OF THE INVENTION

When e.g. an old or badly maintained floor is to be brought in order, it is typically planed/ground off, before it is finished with oil or varnish.

The apparatuses used are typically floor planes/floor grinding machines with either a number of round plates with circular grinding wheels or a grinding cylinder with enclosing grinding belt. Do-it-yourself people experience that it is difficult to achieve uniform grinding of the floor, and that a large amount of grinding wheels or grinding belts are to be used.

The problem with these apparatuses is that dust and/or ground material burns into the grinding wheel/grinding belt, either due to the floor being greasy or due to residues of varnish or lacquer on the floor. This means that it is often necessary to replace the grinding wheel/grinding belt, causing increased costs.

In order to prevent burn-in of dust and/or ground off material, it has been found that simultaneously with grinding cooking oil or similar may be used, but this measure complicates the grinding process.

If floor planes/floor grinding machines are used with rotating round plates with circular grinding wheels, a uniform grinding of the floor is not achieved by running the floor plane/floor grinding machine across it, entailing that time and effort is to be used in moving the floor plane/floor grinding machine back and forth several times.

Another problem with apparatuses where only grinding wheels or grinding belts are used is that these are very exposed if there are nails, screws or other protruding parts on the floor, which thereby may tear apart the grinding wheel or the grinding belt. This entails that the grinding wheel or the grinding belt is to be replaced, even if it is not worn down, and furthermore possibly entailing damage to the round plate or the grinding cylinder, as these are disposed in immediate vicinity of the floor.

In order to achieve sufficient grinding, it is necessary that the round plate or the grinding cylinder are applied a constant pressure down against the floor, entailing that these apparatuses are typically very heavy apparatuses which via their self-weight provides for applying weight upon the round plate or the grinding cylinder. However, the problem is that the apparatus becomes very heavy and cumbersome to transport, and the grinding may easily occur too deeply into the floor if care is not taken.

In U.S. Pat. No. 6,425,813 is disclosed an apparatus for grinding floors and which is provided with a rotating round plate, where circular grinding wheels are used, and where it is the self-weight of the apparatus that provides for the pressure on the circulating round plate.

In U.S. Pat. No. 5,224,301 is disclosed an apparatus for grinding floors and which is provided with a rotating grinding cylinder, where a grinding belt is used which encloses the grinding cylinder, and a tightening wheel. Both apparatuses have one or more of the previously mentioned drawbacks.

In DE A1 42 26 681 is disclosed an apparatus for surface cleaning, and which is provided with two counter-rotating cylinders which may be provided with a number of grinding elements. Furthermore, exhaust of dust and abraded material occurs through a pipe connection. The apparatus is mounted with height adjustable wheels for holding the cylinders at a certain distance from the underlying surface.

In EP A1 0 261 685 is disclosed an apparatus for grinding floors, and which has two grinding cylinders rotating about their own longitudinal axis and about a common point. The apparatus is mounted with height adjustable wheels for holding the cylinders at a certain distance from the underlying surface.

DE A1 42 26 681 and EP A1 0 261 685 have the same disadvantages. For example, they are both large and heavy apparatuses which cannot be easily be lifted by one person, and the weight entails that they may be difficult to manoeuvre. Furthermore, both apparatuses have been fitted with spacers in the form of height adjustable wheels, which is not an advantage as the grinding drums cannot optimally follow the contour of the underlying surface, but the spacing between grinding drum and underlying surface will instead be determined by the contour of the underlying surface at the spots where the wheels are running.

Furthermore, mobile apparatuses for grinding surfaces are known from U.S. Pat. No. 1,904,893, U.S. Pat. No. 1,271,639 and GB 1 038 395.

The apparatuses known herefrom include horizontally oriented grinding cylinders which are enclosed by screens. None of these documents disclose division into an outer and an inner screen which are movably connected, or designs that enable either the inner or the outer screen being divided into a plurality of separate screen members which are mutually movably connected.

OBJECT OF THE INVENTION

The purpose of the present invention is to indicate an apparatus, preferably for grinding a surface, which:

has a simple mechanical structure;

has low self-weight;

is easy to manoeuvre across the surface;

ensure uniform grinding;

reduces the costs of abrasive paper; and reduces the risk of damage on the grinding drum.

This is achieved with an apparatus of the kind specified in the preamble of claim 1, where the screen includes an outer screen and an inner screen which are mutually movably connected, and where the inner screen includes a first suction screen and a second screen which are mutually movably connected.

DESCRIPTION OF THE INVENTION

In a preferred embodiment of the present invention, the apparatus includes:

a grinding unit brought into contact with the underlying surface and thereby providing for the surface treatment of the underlying surface;

a screen guarding the rotating grinding cylinder and providing that dust and abraded material is not spread; and a guide member used for guiding or moving the apparatus across the underlying surface.

The grinding unit is a rotatably arranged grinding cylinder which is provided with a number of preferably replaceable grinding elements in a cylinder surface, entailing that the individual grinding elements are only shortly in contact with the underlying surface, and thereby the wear on the individual grinding elements is reduced.

As the grinding elements are rotating with the grinding cylinder, dust and abraded material will be carried with the grinding elements around and up into the screen that partly guards the grinding cylinder.

Furthermore, dust and/or abraded material will be stricken by the grinding elements when rotating around in the screen, and thereby the grinding action is improved when the grinding element again comes into contact with the underlying surface.

The arrangement with a preferably horizontally arranged grinding cylinder reduces the risk of dust and/or abraded material burns into the grinding elements as these are not in contact with the underlying surface all the time.

Furthermore, this arrangement entails a uniform grinding of the underlying surface over the entire length of the grinding cylinder, meaning that the apparatus is not to be passed so many times across the underlying surface in order to ensure a uniform grinding.

The risk of nails, screws or other projecting parts on the underlying surface damaging the horizontally arranged grinding cylinder is considerably reduced since the grinding cylinder will never come into close contact with the underlying surface because the grinding elements are arranged out from the grinding cylinder.

Furthermore, nails, screws or other projecting parts on the underlying surface will only damage a single or a couple of the grinding elements, a fact not having any great effect on the total grinding efficiency of the apparatus.

In connection with the guide member, activating handles or buttons are provided, whereby the person moving the apparatus can activate rotation of the grinding cylinder and/or the spacers.

In order to shield the grinding cylinder when rotating, and at the same time to prevent dust and/or abraded material from being flung up in the face of the person guiding the apparatus across the underlying surface, the screen includes an outer screen and an inner screen which are mutually movably connected, and where the inner screen includes a first suction screen and a second screen, which are mutually movably connected.

The outer screen is connected to the guide member and movably connected with the inner screen, so that it is possible to move the guide member around at an arbitrary angle, which is an advantage as the apparatus thereby becomes easy to operate for different persons and in places where it is difficult to get at. Moreover, the apparatus may be moved both ways, irrespectively of which way the grinding cylinder rotates.

The inner screen encloses partially the grinding cylinder and is divided into a first suction screen and a second screen which are mutually movably connected, and the suction screen is disposed in front of the second screen in the direction of rotation of the grinding cylinder, entailing that the exhaust of dust occurring from the inner screen occurs in connection with the suction screen where the dust is carried up into the inner screen.

By sucking out the dust already at the inlet part or the first part of the inner screen, the risk of dust being flung around in the inner screen and down upon the underlying surface again, where it can cause accumulation of dust and burning into the grinding elements, is reduced.

The inner screen is formed so that a part of the downwards facing grinding elements are free, whereby it is possible for them to lie down along the underlying surface and thereby grind this without the inner screen unit bumping against the underlying surface.

When initiating a polishing process, the apparatus rests on the grinding cylinder or the edge of the inner screen. When the motor is activated, the grinding cylinder will rotate and slowly yet surely the grinding elements are extended because of the centrifugal force, and thereby the apparatus screen is lifted off the surface, so that it becomes possible to grind the surface by moving the apparatus across the surface.

By utilising the centrifugal force in this way, it is not necessary to mount spacers providing for the screen to have safe distance from the surface, and the grinding cylinder to have spacing from the surface.

The apparatus according to the present invention follows all contours in the underlying surface 100%, as the centrifugal force forces the end parts of the grinding elements as far out as possible.

In order to ensure uniform surface treatment of the underlying surface, the grinding elements are arranged radially in the surface and in parallel in the longitudinal direction of the grinding cylinder, entailing that when the grinding cylinder rotates, one or more grinding elements will be in contact with the underlying surface.

An alternative for arranging the grinding elements radially is to arrange them as a spiral so that the grinding elements wind around along the grinding cylinder in its longitudinal direction.

In order to achieve grinding of an underlying surface, the grinding elements include at least one piece of abrasive paper, whereby the abrasive paper comes into contact with the underlying surface when the grinding elements are moved around.

The grinding elements may be of the type where the abrasive paper is connected with a base part having a shape that fits the shape of undercut grooves in the surface of the grinding cylinders. In that way it is easy and quick to replace the grinding elements when the abrasive paper becomes worn.

Alternatively, the grinding elements may be of the type where the grinding paper is supported by brushes which are also arranged in the base part of the grinding element. In that way it is ensured that the grinding paper is standing more upright during grinding, and thereby a stronger grinding of the underlying surface is ensured.

If brushes are used, it will typically only be possible to achieve a grinding action by rotating the grinding cylinder in one direction. By using sandpaper with sand grains at both sides, or by folding the sandpaper, it is possible to achieve an abrasive effect irrespectively of the direction of rotation of the grinding cylinder.

An alternative to the grinding elements comprises at least one piece of abrasive paper where the grinding elements include one or more the following: abrasive strips, abrasive threads or wires, steel brushes and/or plastic brushes.

If the apparatus is to be used for polishing an underlying surface, the grinding elements will include at least one polishing member, as e.g. cloths, brushes and/or threads which are typically made of a soft fabric.

In order to avoid that the inner screen scratches the underlying surface, or to ensure a certain vacuum inside the inner screen so that dust and/or abraded material can be conducted away with sufficient speed, the first suction screen and the second screen are provided with brushes along a lower edge. Furthermore, the brushes ensure that the apparatus is moved smoothly across the surface.

The length of the brushes and the type of the brushes may vary between suction screen and the second screen, so that it is possible to mount soft brushes on one of the screens while slightly longer and harder brushes may be mounted on the second screen.

When the underlying surface is ground, some dust and/or abraded material is produced which is flung out to the surroundings. In order to avoid that dust and/or abraded material is spread unsuitably, dust and/or abraded material is to be removed from the inner screen as quickly as possible.

In an embodiment of the present invention the guide member includes an internal duct and a pipe connection, where the internal duct connects the suction screen and the pipe connection which is adapted for connecting a suction unit. From the pipe connection there is air access through the internal duct right into the suction screen, so that dust and/or abraded material is removed at the source. By establishing exhaust from the guide member it becomes easier to manoeuvre the apparatus since long hose connections are no longer to be dragged along.

In an embodiment of the present invention, the screen is provided with a pipe connection which is adapted for connecting a suction unit which e.g. may be provided with flexible hoses. From the pipe connection there is air access right into the suction screen, so that dust and/or abraded material is removed at the source. As the inner and outer screens are mutually movable, there will, however, also be induced exhaust between the inner and outer screens.

The suction unit may be an industrial vacuum cleaner standing alongside the apparatus, or the suction unit may include a container which is mounted on the apparatus, and which is connected to an external vacuum cleaner.

In order to drive the grinding cylinder and thereby achieve grinding of the underlying surface, the grinding cylinder includes a drum motor, or the apparatus includes a motor which is drivingly connected with the grinding cylinder.

The motor is to be dimensioned so that it may drive the grinding cylinder irrespectively of how hard it is pressed down upon the underlying surface. The motor is typically electrically powered, but may alternatively be powered by fuel, e.g. petrol-powered or similar.

The transmission between motor and grinding cylinder may be a drive belt, a chain, a toothed belt, or similar means.

In a preferred embodiment, the motor is provided with a soft-starter and may be frequency-controlled, whereby the apparatus can be started softly and quietly. When the apparatus attains the rotational speed required for the grinding cylinder to lift itself off the underlying surface, the apparatus is ready for grinding.

Furthermore, frequency control of the motor entails that it is possible to achieve optimal grinding of the underlying surface when adjusting the frequency, thereby adjusting the rotational speed to e.g. various surface types, wear on the grinding elements and the actual step in the grinding process.

The shape of the guide member is different, depending on which type of surface desired to be ground. For example, the guide member may be linear if plane surfaces are to be ground, while the guide member for grinding windmill wings will typically be curved, so that the guide member does not strike the windmill wing when the grinding cylinder follows the contour of the windmill wing.

The apparatus according to the present invention is described as applied to grinding an underlying surface, typically a wooden floor, but the apparatus may be envisaged applied to other approximately horizontally arranged surfaces, as e.g. a windmill wing, a building front, and/or a section of a ship.

The apparatus according to the present invention may be envisaged applied to grinding surfaces of wood and metal and for polishing wood, metal and/or glass faces.

DESCRIPTION OF THE DRAWING

In the following, the invention will be explained in more detail with reference to the enclosed drawing where.

DETAILED DESCRIPTION OF THE INVENTION

Figure 1:
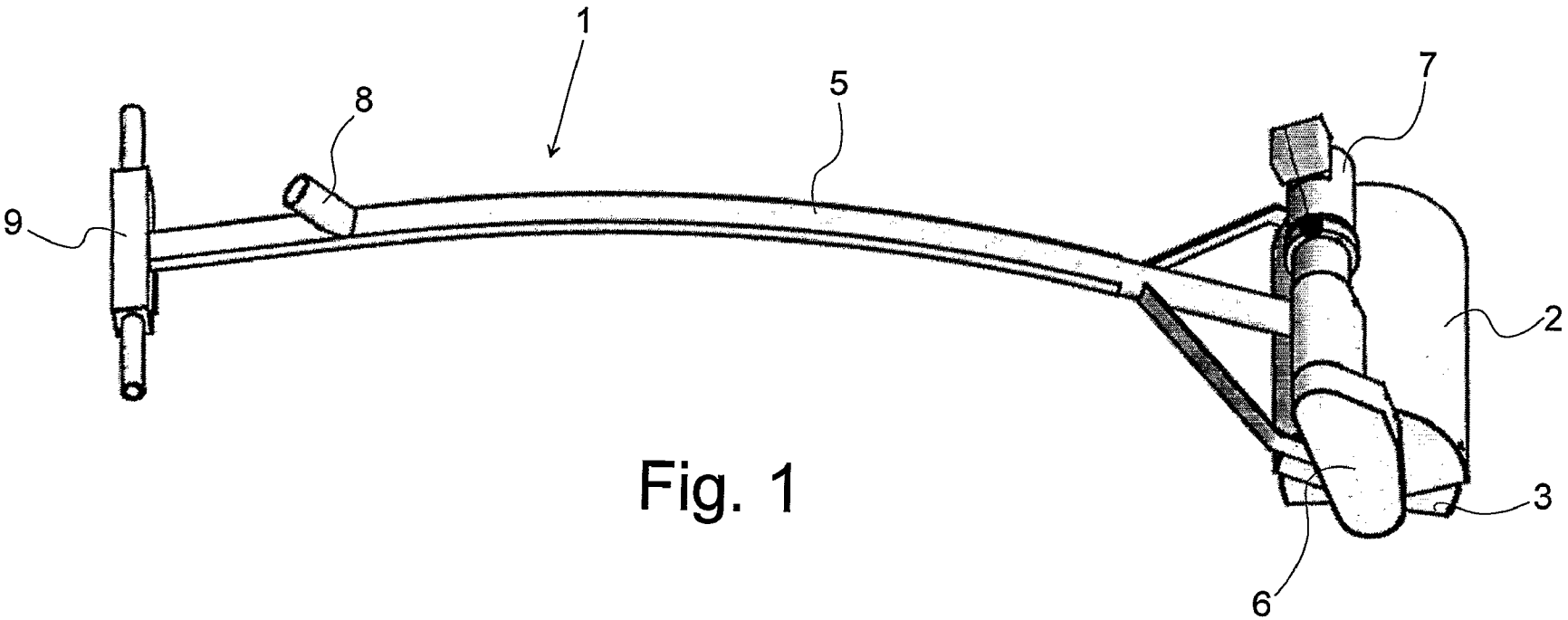
FIGS. 1-2 shows an apparatus according to the invention.
Figure 2:
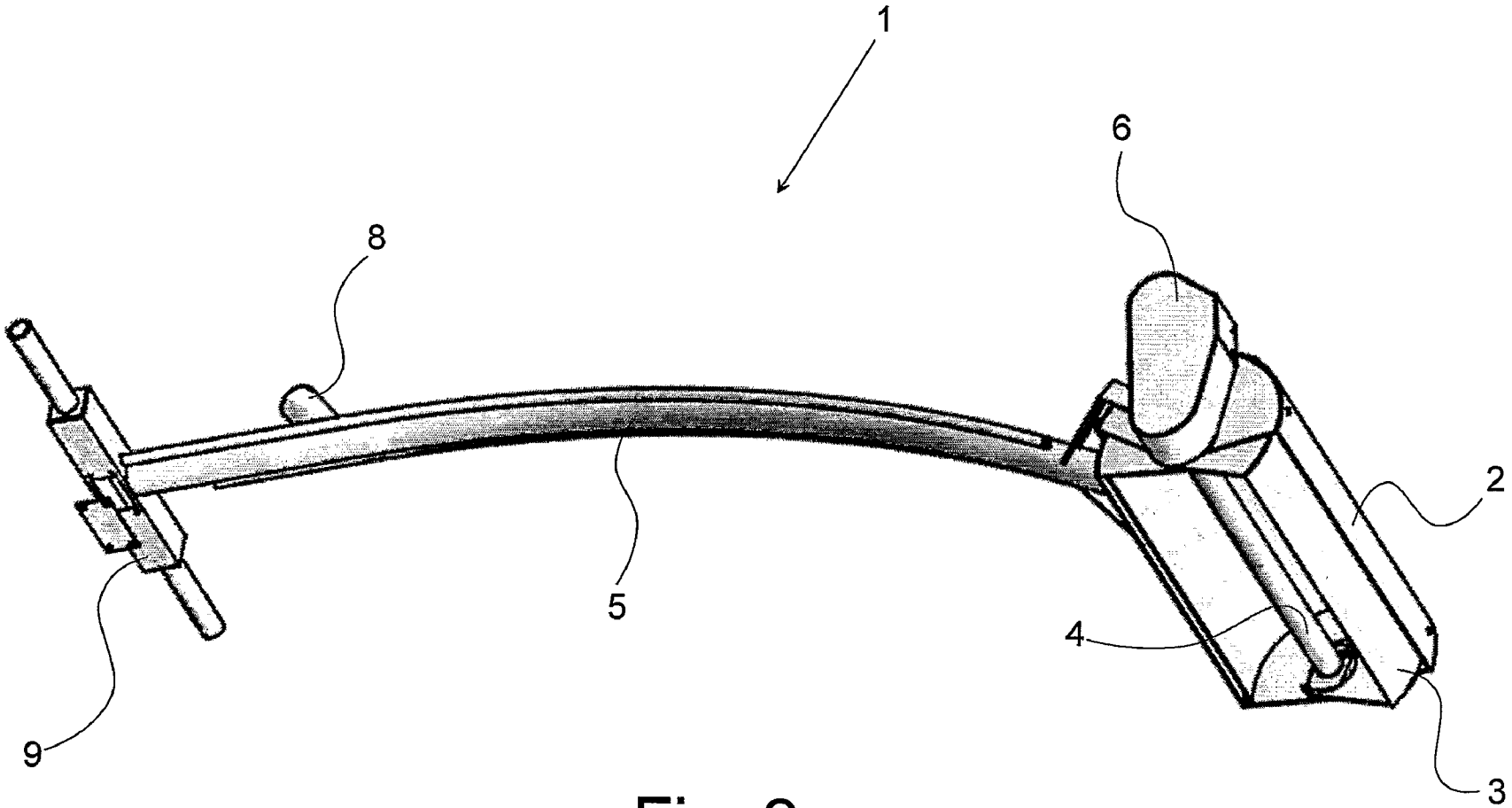

FIGS. 1-2 shows an apparatus 1 according to the invention, including a grinding unit 13 (see FIG. 3) in the form of a grinding cylinder 14 which is provided with a number of grinding elements 15 (only two illustrated in FIG. 3), an inner screen 3 guarding the rotating grinding cylinder 14, an outer screen 2 connected with a guide member 5 which is used for moving the apparatus 1 across the underlying surface (not shown).

The inner screen 3 and the outer screen 2 are mutually movably connected so that it is possible to adjust the height of the guide member 5 during the grinding process. The grinding cylinder 14 is adapted for mounting on a shaft 4 within the inner screen 3, whereby this partly encloses the grinding cylinder 14. In the shown embodiment, the motor 7 is drivingly connected with the shaft 4 via a toothed belt 10 (see FIG. 3) which is disposed behind screen 6.

At the end close to the handle 9, the guide 5 is provided with a pipe connection 8 for connecting a suction unit (not shown), and the guide member 5 includes an internal duct (not shown) providing for exhaust of dust and/or abraded material from the inner screen 3. In the shown embodiment, the guide member 5 is shaped with a curving bend, whereby this embodiment of the present invention is particularly suited for grinding of windmill wings (not shown), as the shape of the guide member 5 prevents the guide member 5 from striking the windmill wing (not shown) when the grinding drum (not shown) follows the curving surface of the windmill wing (not shown).

Figure 3:
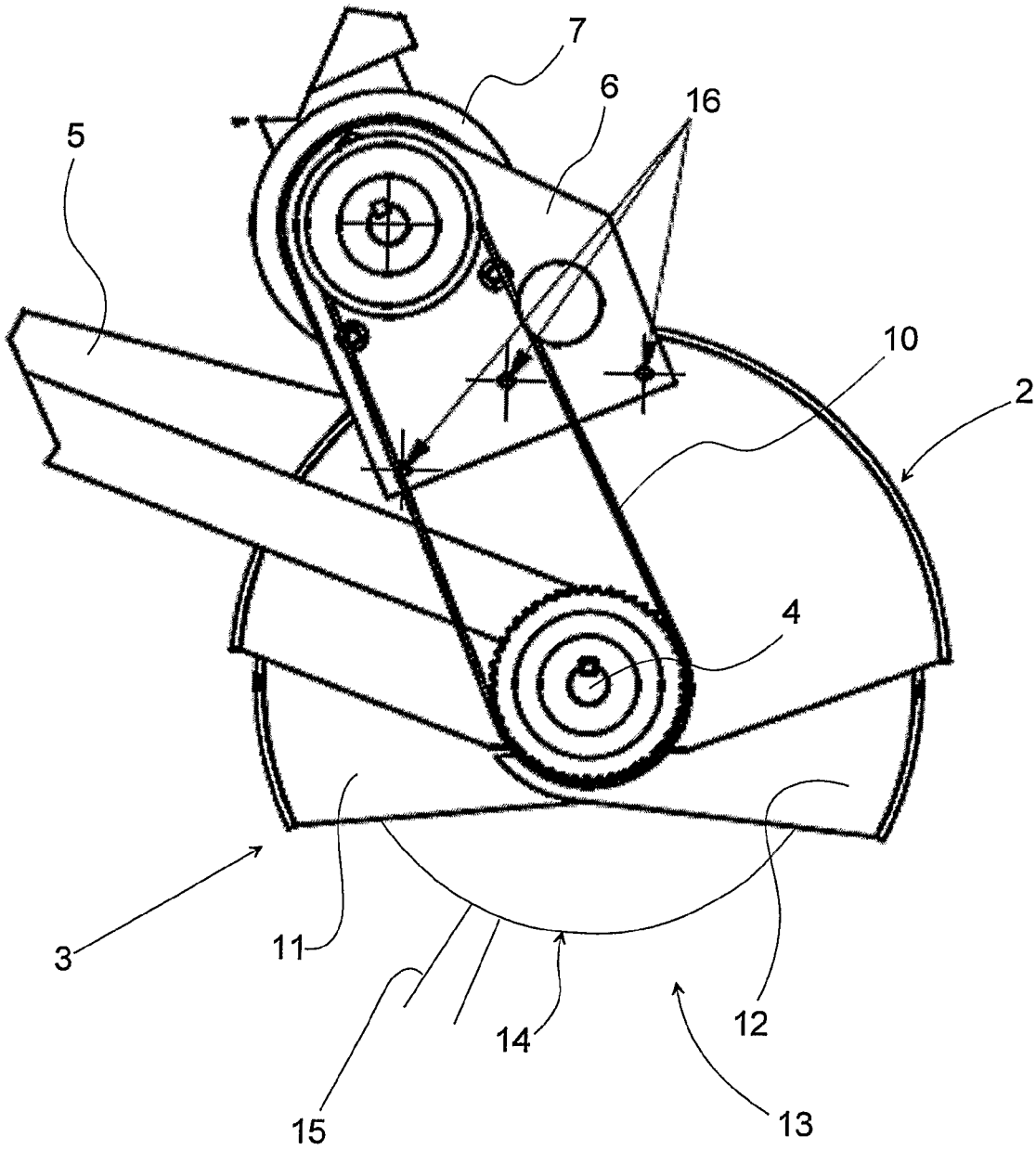
FIG. 3 shows a partial view of the apparatus.

FIG. 3 shows a side view of the screens 2, 3 of the apparatus, and where the inner screen 3 is divided into a suction screen 11 and a second screen 12, where the suction screen 11 is disposed clockwise before the second screen 12. The guide member 5 is connected with the outer screen 2, whereby it is possible to turn the guide member 5 around the inner screen 3, including the grinding unit 13 with the grinding cylinder 14 and the grinding elements 15 (not shown). The motor 7 is drivingly connected with the shaft 4 via a toothed belt 10 which is mounted under the screen 6 which is fastened by means of bolts 16.

Figure 4:
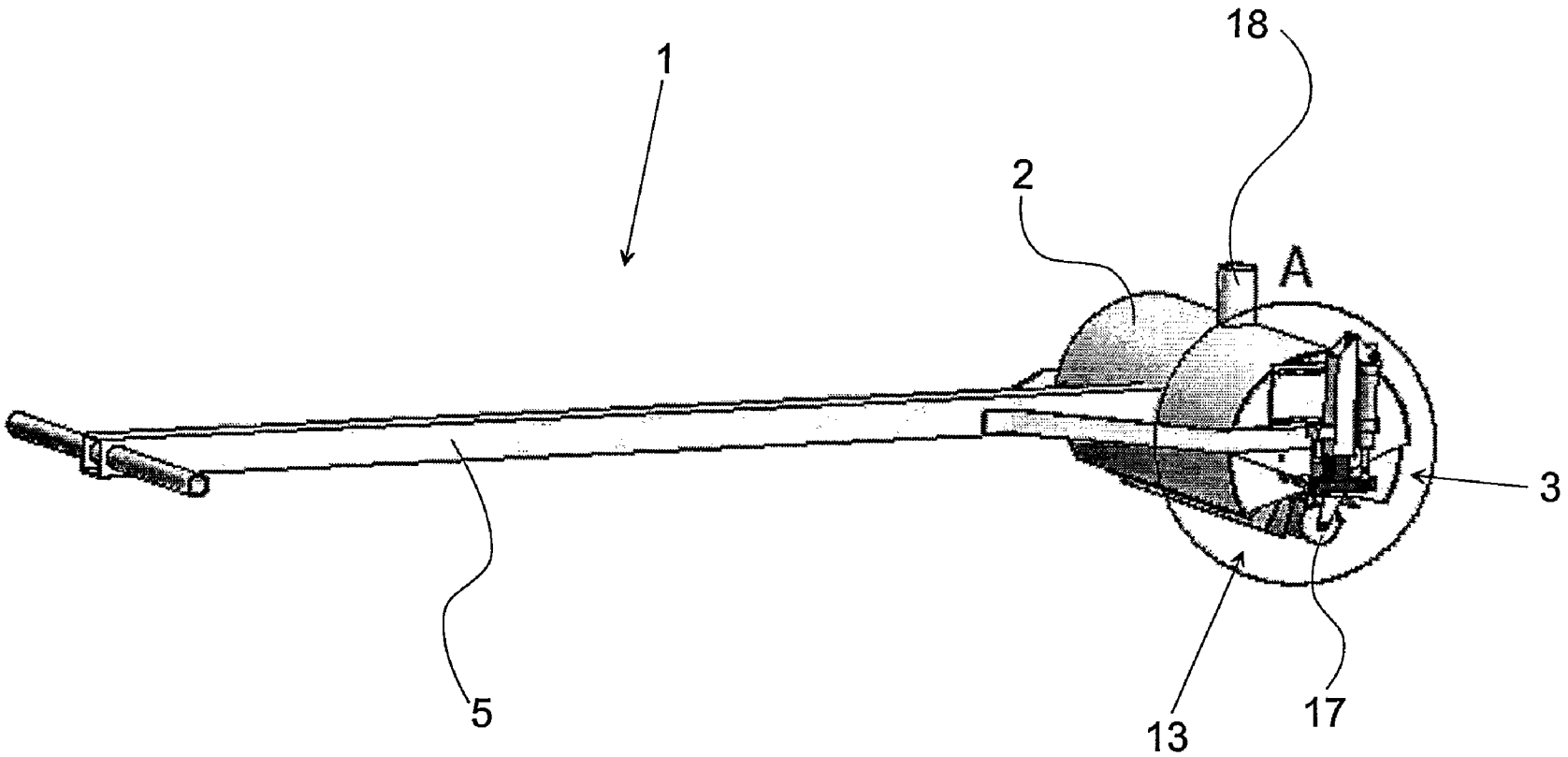
FIG. 4 shows a view of an apparatus according to a further embodiment of the invention.

FIG. 4 shows an apparatus 1, including a rotating grinding unit 13, an outer screen 2 and an inner screen 3 shielding the rotating grinding unit 13, a couple of spacers 17 which are used for adjusting the height of the grinding unit 13 above the underlying surface (not shown), and a guide member 5 used for guiding the apparatus 1 across the underlying surface (not shown).

The screen 3 is provided with a pipe connection 18 for connecting a suction unit (not shown) and the spacers 17 and enclosing the grinding cylinder 2 and connected with guide member 5.

Figure 5:
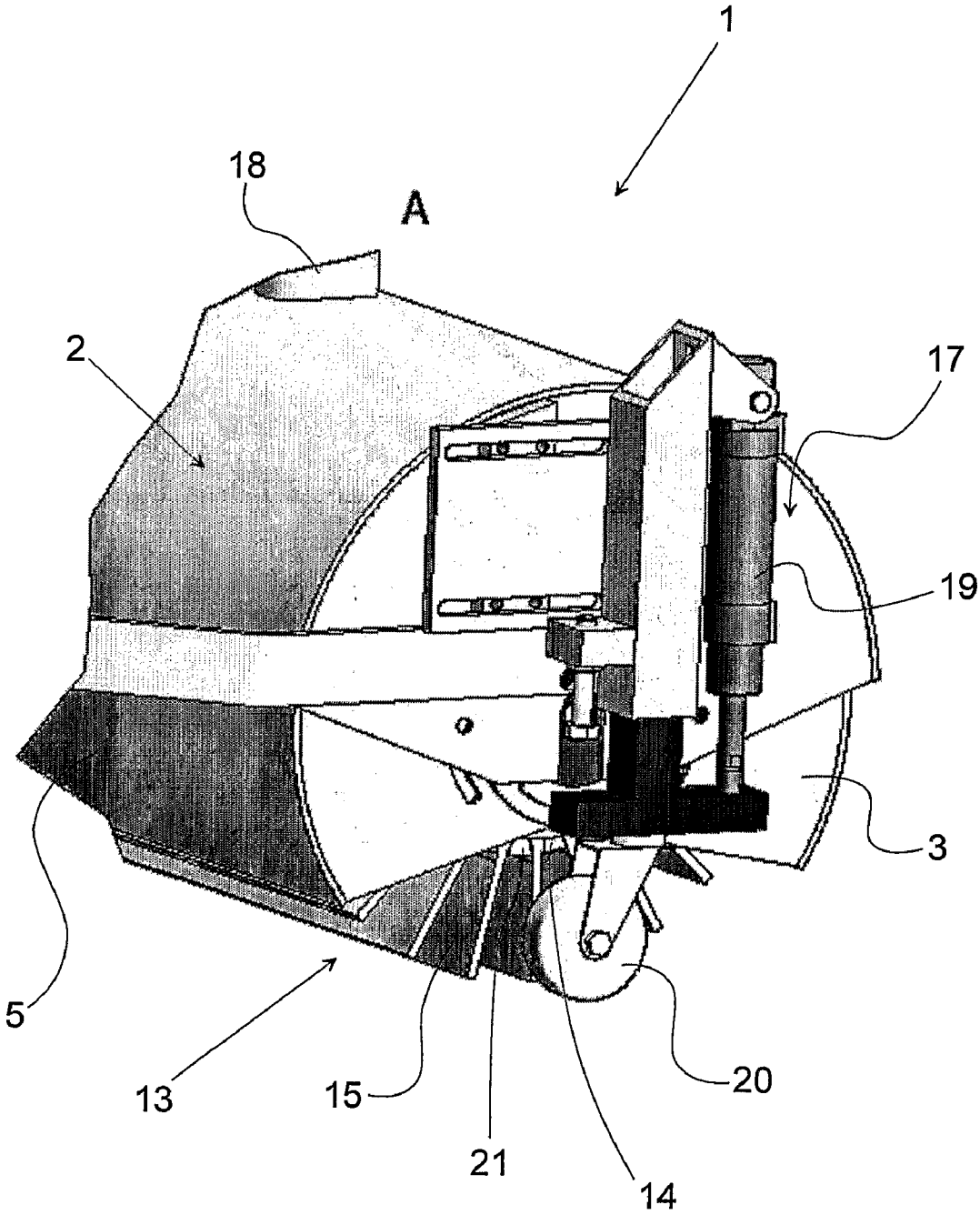
FIG. 5 shows a partial view of the apparatus shown in FIG. 4.

FIG. 5 shows a detail of the apparatus 1, where it can be seen that the screen is divided into an inner screen 3 and an outer screen 2 which are mutually movably connected. The guide member 5 is connected with the outer screen 2 whereby it is possible to turn the guide member 5 around the grinding unit 13.

The outer screen 2 is connected with the spacers 17 which include displacing means 19 in the form of a cylinder whereby it is possible to adjust the height of the grinding unit 13 above the underlying surface (not shown).

The displacing means 19 is connected with wheels 20 provided for easy moving the apparatus 1 across the underlying surface (not shown).

The grinding unit 13 includes a grinding cylinder 14 which is provided in a surface 21 with a number of preferably replaceable grinding elements 5 arranged radially and in parallel.

The invention claimed is:

1. An apparatus (1) for grinding a surface, including at least one grinding unit, a screen (2, 3) and a guide member (5), where the grinding unit is a rotatable grinding cylinder, which at a cylinder surface is provided with a number of grinding elements, where the screen (2, 3) entirely or partly encloses the grinding unit, and wherein the guide member (5) is connected with the screen (2), characterised in that the screen includes an outer screen (2) and an inner screen (3) which are mutually pivotally connected, and where the inner screen (3) includes a first suction screen (11) and a second screen (12) which are mutually pivotally connected.

2. Apparatus (1) according to claim 1, characterised in that the guide member (5) includes an internal duct and a pipe connection (8), where the internal duct connects the suction screen (11) and the pipe connection (8) which is adapted for connecting a suction unit.

3. Apparatus according to claim 1, characterised in that the outer screen (2) is provided with a pipe connection adapted for connecting to a suction unit.

4. Apparatus according to claim 1, characterised in that the first suction screen (11) and the second screen (12) are provided with brushes along a lower edge.

5. Apparatus (1) according to any of claims 1-4, characterised in that the grinding elements are arranged radially on the cylinder surface and in parallel in the longitudinal direction of the grinding cylinder.

6. Apparatus (1) according to claim 5, characterised in that the grinding elements include at least one piece of abrasive paper.

7. Apparatus (1) according to any of claims 1-6, characterised in that the apparatus (1) includes a motor (7) which is drivingly connected with the grinding cylinder.

8. Apparatus according to any of claims 1-7, characterised in that the grinding cylinder includes a drum motor.

9. Apparatus according to claim 1, wherein the grinding cylinder is horizontally arranged.

10. Apparatus according to claim 1, wherein the grinding elements are replaceable.

* * * * *